US006144309A

United States Patent [19]

Fagence

[11] Patent Number: 6,144,309

[45] Date of Patent: Nov. 7, 2000

[54] ALARM DEVICE WITH MULTIPLE INDICATORS AND FLAMEPROOF HOUSING

[75] Inventor: David Alan Fagence, Carshalton, United Kingdom

[73] Assignee: Signature Industries Limited, United Kingdom

[21] Appl. No.: 09/297,894

[22] PCT Filed: Oct. 28, 1997

[86] PCT No.: PCT/GB97/02959

§ 371 Date: Aug. 11, 1999

§ 102(e) Date: Aug. 11, 1999

[87] PCT Pub. No.: WO98/20466

PCT Pub. Date: May 14, 1998

[30] Foreign Application Priority Data

Nov. 7, 1996 [GB] United Kingdom ..... 9623209

[51] Int. Cl.[7] ..... G08B 3/00

[52] U.S. Cl. ..... 340/691.1; 340/326; 340/332; 340/331; 340/384.1; 340/385.1; 381/340; 381/341; 381/342

[58] Field of Search ..... 340/691.1, 326, 340/332, 384.1, 506, 691, 546, 691.3, 693.5, 693.11, 286.05, 287, 302, 693.6, 331, 385.1; 381/340, 341, 342, 160, 152; 181/155

[56] References Cited

U.S. PATENT DOCUMENTS

| | | | |
|---|---|---|---|
| 4,074,244 | 2/1978 | Balderson | 340/244 R |
| 4,228,784 | 9/1981 | Fusco | 340/326 |
| 4,257,039 | 3/1981 | Webb et al. . | |
| 4,288,784 | 9/1981 | Fusco | 340/326 |
| 4,518,946 | 5/1985 | Solomon | 340/326 |
| 4,730,184 | 3/1988 | Bach | 340/691 |
| 4,855,723 | 8/1989 | Fritz et al. | 340/691 |
| 4,893,343 | 1/1990 | Bader | 381/156 |
| 4,996,517 | 2/1991 | Kringen et al. | 340/506 |
| 5,019,805 | 5/1991 | Curl et al. | 340/628 |
| 5,132,659 | 7/1992 | Kuo | 340/326 |
| 5,166,665 | 11/1992 | McCarthy | 340/546 |
| 5,477,205 | 12/1995 | Burns | 340/332 |
| 5,557,294 | 9/1996 | Leslie | 345/32 |
| 5,825,280 | 10/1998 | Merendini et al. | 340/326 |
| 5,898,363 | 4/1999 | Altilio | 340/384.1 |
| 5,953,436 | 9/1999 | Zimmermann | 381/396 |
| 5,990,789 | 11/1999 | Berman et al. | 340/506 |

FOREIGN PATENT DOCUMENTS

| | | |
|---|---|---|
| 2 064 190 | 6/1981 | United Kingdom . |
| 2 100 039 | 12/1982 | United Kingdom . |

*Primary Examiner*—Jeffery A. Hofsass
*Assistant Examiner*—Tai T. Nguyen
*Attorney, Agent, or Firm*—Michael Best & Friedrich LLP

[57] ABSTRACT

An alarm device 10 incorporates a sounder 11 and a strobe 12. The sounder and the strobe are controlled by a circuit board 17 that is located within a single flameproof housing 13. A pressure unit 23 produces the sound for the device with the sound passing through a sintered disc 24 into an upwardly and outwardly diverging cone 25 from the top of which the sound is reflected outwardly and downwardly within a dome 26. A ramp 27 then assists in reflecting and emitting the sound.

11 Claims, 3 Drawing Sheets

ALARM DEVICE WITH MULTIPLE INDICATORS AND FLAMEPROOF HOUSING

FIELD OF THE INVENTION

The present invention relates to an alarm device, a method of operating an alarm device and a kit of parts for assembly into an alarm device.

A known audible and visual alarm for use in potentially flammable atmosphere comprises two separate alarms each comprising a flameproof housing, one having a sounder attached and the other having a strobe. It is desired to keep the space within the housing as small as possible in order to minimise the amount of flame and the size of any explosion within the housing that may occur. The alarms are normally mounted with a housing facing a wall and with the sounder or strobe on the other end of the housing facing away from the wall. The sounder and strobe face away from the wall in order to emit the sound and light away from the wall. The provision of two housings to provide an alarm that emits both sound and light is expensive and a considerable amount of engineering has to be put into the manufacture of the housings as they must be able to resist an explosion within the housing without any flame reaching the atmosphere outside of the housing.

U.S. Pat. No. 4,288,784 discloses an audio visual alarm device with an automatic dusk to dawn security light, a selectively energisable rotating signal light and an audible electrically actuated siren. U.S. Pat. No. 5,132,659 discloses a flashing light siren alarm which, when activated, provides a bright flashing strobe light and a loud siren sound which attract attention. The purpose of both of the prior U.S. Patents is to deter intruders.

It is an object of the present invention to attempt to overcome at least some of the above described disadvantages.

SUMMARY OF THE INVENTION

According to one aspect of the present invention an alarm device incorporates a housing, the housing being adapted to have two alarms operating therefrom and the housing being flameproof.

Each alarm may be arranged to be at opposed portions of the housing.

At least one of the alarms may be an audible alarm. The audible alarm may be arranged to be mounted on top of the housing. The audible alarm may be arranged to emit sound around the periphery of the housing and may emit sound substantially around the complete periphery of the housing. The audible alarm may be arranged to emit sound downwardly over the housing.

Sound from the audible alarm may be arranged to be emitted towards the housing. The housing may include a sound deflecting portion arranged to deflect sound travelling towards the housing to a direction in which the sound travels away from the housing. The sound deflecting portion may comprise a ramp surface and that surface may extend towards the housing in an outwardly diverging direction.

At least one alarm may be a visual alarm. The visual alarm may be arranged to depend downwardly from the housing. The visual alarm may be arranged to emit light outwardly from the housing and the visual alarm may be arranged to emit light around substantially the complete periphery of the housing.

The visual alarm may include a light transmitting portion that comprises part of the flameproof housing.

The device may include a coloured lens that can be attached to, or detached from the device without affecting the flameproof housing.

The flameproof housing may include control means arranged to control both alarms. The control means may comprise a printed circuit board. The control means may be selected from one of a plurality of alternative control means, each of which can give a different control.

The present invention also includes a method of operating an alarm device, which device includes a flameproof housing, the method comprising emitting two alarms from separate alarms of the device.

The method may comprise emitting the two alarms at the same time or at different times. The method may comprise emitting an audible alarm and, alternatively or additionally, a visible alarm.

Sound from the audible alarm may be emitted around substantially the complete periphery of the device.

The sound from the audible alarm may travel towards the housing and then be deflected to a direction in which the sound travels away from the housing.

The method may comprise controlling the alarms with control means located within the housing.

The present invention also includes a method of operating an alarm device when the alarm device is as herein described.

According to a further aspect of the present invention a kit of parts for assembly into an alarm device comprises a housing and at least two attachments, at least one of which is an alarm, the method comprising selecting the required attachments and attaching those to form an alarm device that comprises a flameproof housing.

At least one of the attachments that comprises an alarm may comprise part of the flameproof housing.

The kit of parts may also include an attachment comprising a cover that can be connected to the housing, in place of an alarm, in order to form a flameproof housing at that location.

The method also includes selecting one of a plurality of control devices and mounting that control device within the housing with the control device being selected in accordance with the alarm to be emitted.

In the present specification one of the alarms has been described as being an audible alarm. Such an alarm will also include a loud speaker for giving information.

According to a further aspect of the present invention an alarm device comprises a housing and an audible alarm, the audible alarm being arranged to emit sound towards the housing and the device being arranged to deflect that sound to a direction away from the housing.

The present invention also includes a method of operating an alarm device comprising emitting sound towards a housing of the alarm device and deflecting that sound away from the housing.

The present invention includes any combination of the herein referred to features or limitations.

BRIEF DESCRIPTION OF THE DRAWINGS

The present invention may be carried into practice in various ways but one embodiment will now be described, by way of example, and with reference to the accompanying drawings, in which.

DESCRIPTION OF PREFERRED EMBODIMENTS

Figure 1:
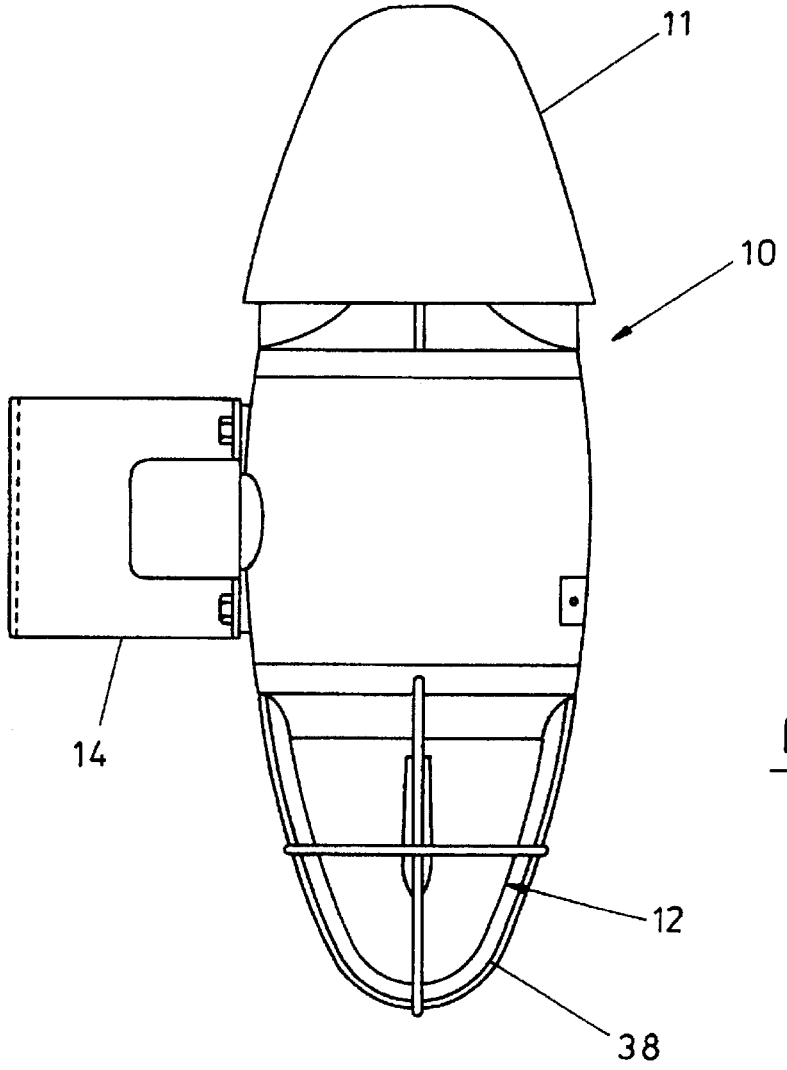
FIG. 1 is a side view of an alarm device 10 incorporating a sounder 11 and a strobe 12.
Figure 2:
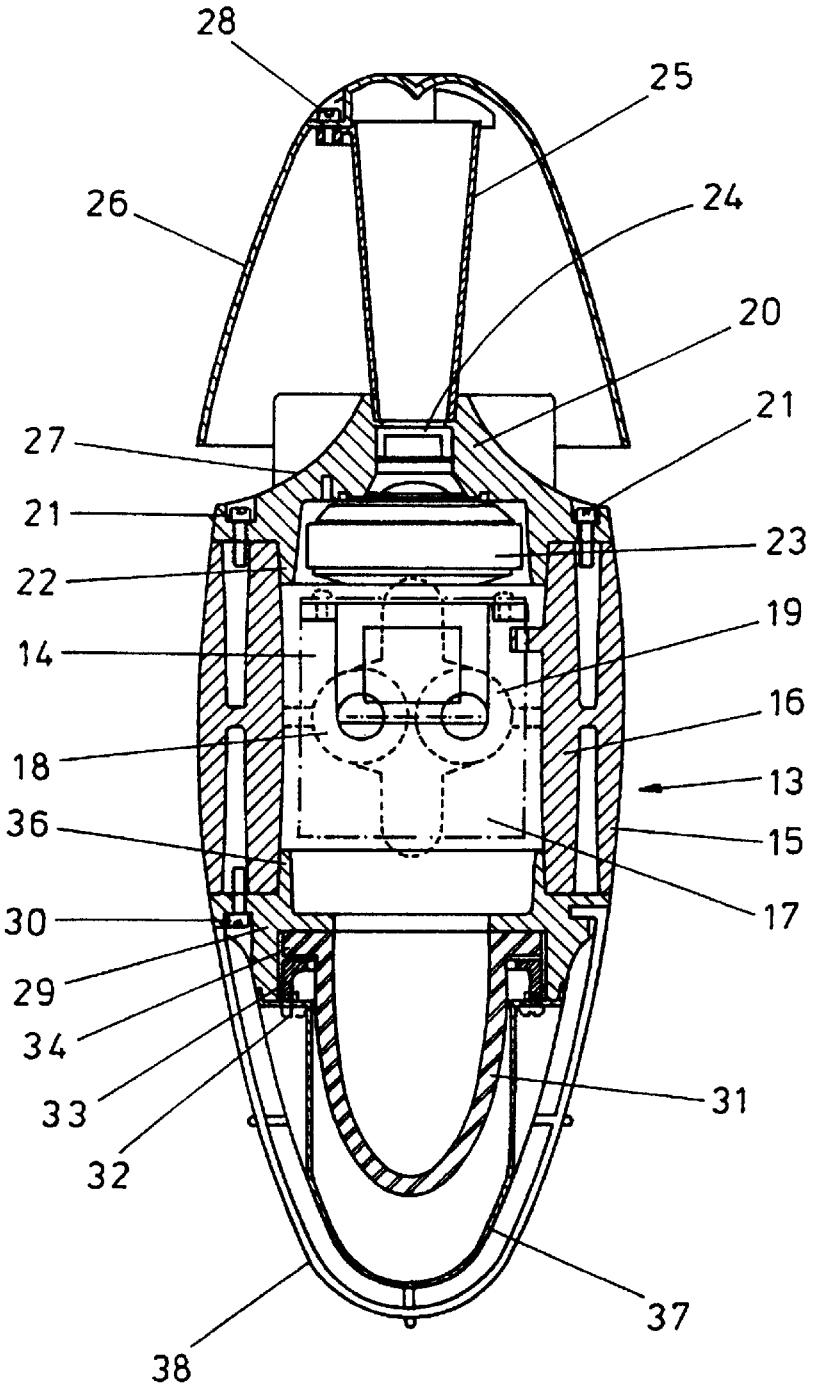
FIG. 2 is a sectional view of FIG. 1.

As shown in the drawings, an alarm device 10 incorporates, in FIGS. 1 and 2, a sounder 11 and a strobe 12 with the sounder being connected to the top of a flameproof housing 13 and the strobe being connected to the bottom of that housing. The device is arranged to be mounted on a wall by a bracket 14 shown in FIGS. 1 and 5 such that the sounder extends upwardly from the housing and the strobe depends downwardly.

The strobe 12 is visible to persons in the vicinity of the alarm. The sounder, although extending upwardly, emits its sound downwardly over the complete periphery of the housing and outwardly.

The flameproof housing 13 is shown in more detail in FIG. 2. It comprises a generally cylindrical outer wall 15 that tapers slightly towards the upper and lower ends. The wall 15 is connected to, and integral with, an inner cylindrical wall 16 that is concentric with the outer wall 15 but spaced slightly therefrom. The wall 16 contains an axially extending printed circuit board 17 that dictates the functions of the strobe and sounder. The walls 15 and 16 contain openings 18 and 19 into and out of which power and operating cables (or rigid conduit) are connected in a known, sealed, flameproof manner.

Figure 5:
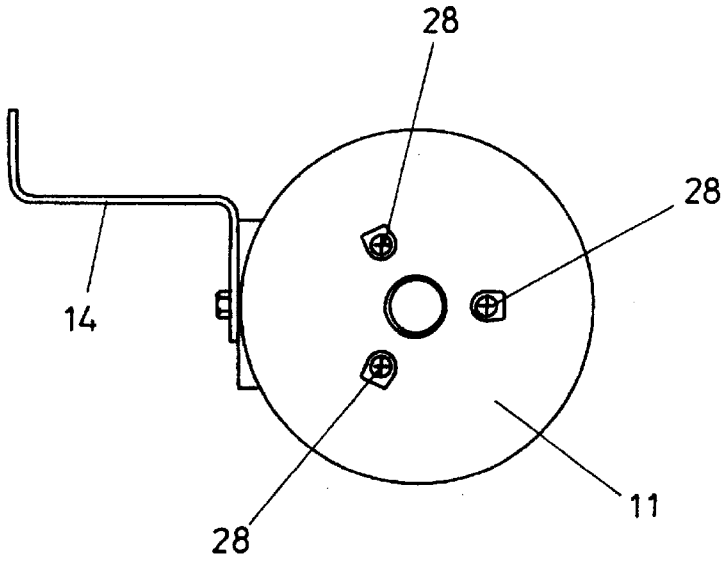
FIG. 5 is a plan view of FIG. 1.

At the upper end of the walls 15 and 16 an end cap 20 is provided, that cap being connected by screws 21 to the walls 15 and 16 with the cap including a downwardly extending rim 22 that is in contact with the inner surface of the wall 16. The cap 20 supports the pressure unit 23 that produces the sound for the device with, above that unit 23, a sintered disc 24 of metal foam being provided. Sound from the unit 23 passes upwardly, through the disc 24 into an upwardly and outwardly diverging cone 25 from the top of which it is reflected outwardly and downwardly within a dome 26. The base of the dome 26 is spaced from the cap 20 and sound is thus emitted from the device. The top surface of the cap includes a downwardly and outwardly expanding annular ramp 27 that assists in reflecting and emitting the sound efficiently. The dome 26 is mounted on and connected to the cone 25 by three screws 28, as shown in FIG. 5.

Should an explosion occur in the housing then the walls of the housing will contain that force. The tortuous path created by the rim 22 of the cap and the joint of the cap with the top of the housing will prevent any flame from leaving the housing in that direction and the sintered disc 24 will prevent any flame from leaving through the top of the cap.

At the lower end of housing a cap 29 is attached by screws 30. A hardened glass dome 31 containing the light source is attached to the cap 29 by screws 32 which urge an annular flange 33 against a rim 34 of the dome to hold the dome firmly against an inwardly extending plate 35 of the cap 29. Alternatively the rim 34 may be attached to the plate 35 with the flange 33 threadably engaging with the cooperating portion of the cap 29. Should an explosion occur within the housing then flame is not able to escape past the dome because of the tortuous path provided by the plate 35, the rim 34 and the flange 33. The cap 29 includes an upwardly extending rim 36 that fits within the housing to prevent any flame from being able to escape around the joint of the cap with the housing.

The screws 32 that hold the dome in place also serve to attach a coloured lens 37. A protective wire frame 38 is clipped into the cap by flexing inwardly projecting ends 39 of the frame into sockets provided on the cap.

Accordingly it can be seen that the single housing containing the single printed circuit board is able to control both the sounder and the strobe. The switching for the sounder or strobe is provided by the printed circuit board. The sounder can emit different sounds or frequencies of sound to give an alert that there is toxic gas present, or to give a general alarm, for instance.

It is also possible for the sounder to be replaced by a loudspeaker to give announcements, for instance. The loudspeaker will be similar in construction and attachment to the sounder but a different printed circuit board will be used. Alternatively, a sounder could be provided at both ends of the housing or a strobe could be provided at both ends or any combination of loudspeaker, strobe and sounder could be used. An appropriate printed circuit board would be used for each different alarm unit.

Each alarm can be operated simultaneously with another alarm or separately therefrom.

Figure 6:
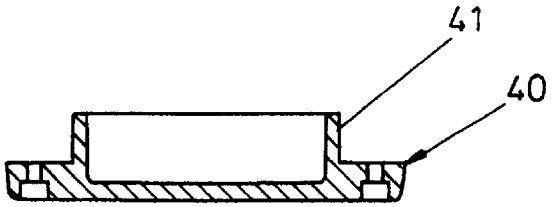
FIG. 6 is a side sectional view of a closure of the housing.
Figure 3:
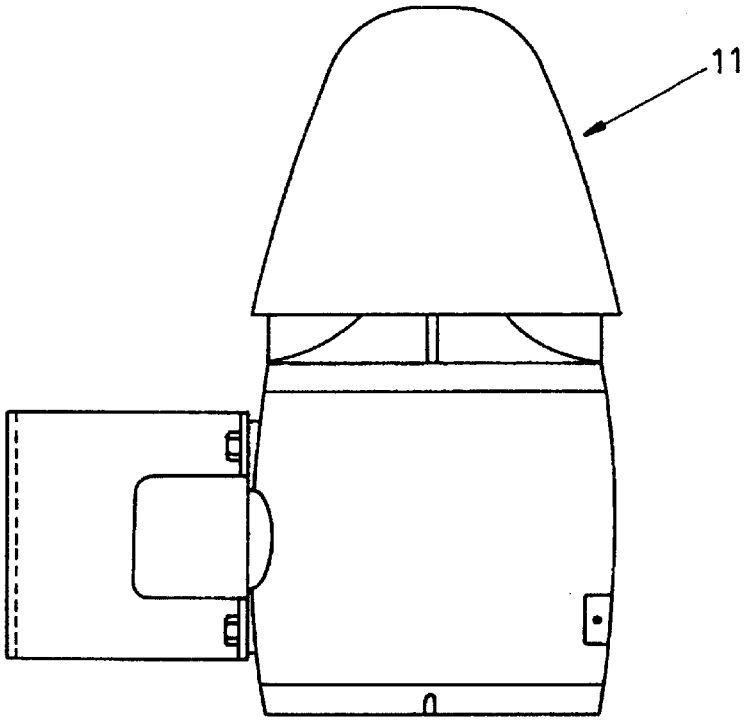
FIG. 3 is a side view similar to FIG. 1 incorporating only the sounder 11.
Figure 4:
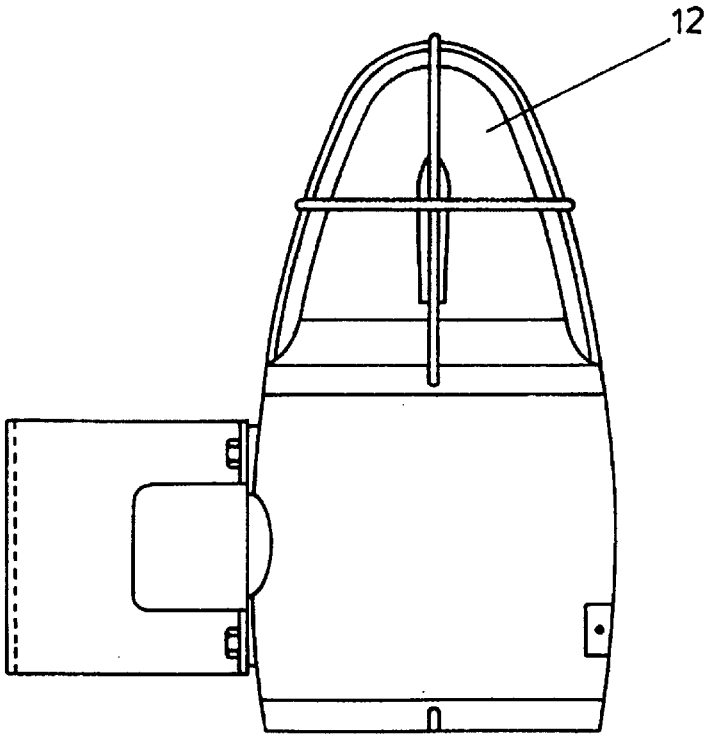
FIG. 4 is a side view of the alarm device incorporating only the strobe 12.

FIG. 3 shows an alarm unit that incorporates only a sounder 11 and FIG. 4 shows a unit with just a strobe 12. In each case the end of the housing that is not used is closed off with the cap 40 shown in FIG. 6 that includes an inwardly directed rim 41.

It can be seen that the coloured lens can be attached, or a coloured lens can be replaced without tampering with the flameproof enclosure.

The housing and the caps are made of suitable metal and can be made of stainless steel or aluminium alloy or of plastics and may be moulded.

The reader's attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

What is claimed is:

1. An alarm device (10) incorporating a housing (13), the housing being adapted to have two alarms (11,12) operating therefrom in which one of the alarms is an audible alarm (11) and the other alarm is a visual alarm (12), the device including a light transmitting portion, said light transmitting portion comprising part of the housing, the housing being flameproof whereby the housing is constructed such that in the case of an explosion occurring in the housing the flames will be prevented from leaving the housing, the housing including control means comprising a printed circuit board (17) arranged to control both alarms.

2. A device as claimed in claim 1 including a dome mounted on top of the housing arranged to emit sound from the audible alarm downwardly towards the housing.

3. A device as claimed in claim 1 in which each alarm is arranged to be at opposed portions of the housing.

4. A device as claimed in claim 1 including a coloured lens that (37) can be attached or detached from the device without affecting the flameproof housing.

5. A device as claimed in claim 1 in which the control means (17) are selected from one of a plurality of alternative control means, each of which can give a different control.

6. An alarm device (10) incorporating a housing (13), the housing being adapted to have two alarms (11,12) operating therefrom in which one of the alarms is an audible alarm (11) arranged to emit sound, the device including a dome mounted on top of the housing arranged to emit sound from the audible alarm downwardly towards the housing, and the other alarm is a visual alarm (12), the device including a light transmitting portion, said light transmitting portion comprising part of the housing, the housing being flameproof whereby the housing is constructed such that in the case of an explosion occurring in the in the housing the flames will be prevented from leaving the housing.

7. A device as claimed in claim 6 in which the audible alarm is arranged to be mounted on top of the housing.

8. A device as claimed in claim 6 in which the audible alarm is arranged to emit sound substantially around the complete periphery of the housing.

9. A device as claimed in claim 6 in which the housing includes a sound deflecting portion (27) arranged to deflect sound travelling towards the housing to a direction in which the sound travels away from the housing.

10. An alarm device (10) incorporating a housing (13), the housing being adapted to have two alarms (11,12) operating therefrom in which one of the alarms is an audible alarm (11) and the other alarm is a visual alarm (12), the device including a coloured lens (37) that can be attached or detached from the device without affecting the housing, the housing being flameproof whereby the housing is constructed such that in the case of an explosion occurring in the housing the flames will be prevented from leaving the housing, the housing including control means comprising a printed circuit board (17) arranged to control both alarms.

11. A device as claimed in claim 10 in which the control means (17) are selected from one of a plurality of alternative control means, each of which can give a different control.

* * * * *